US006266896B1

(12) United States Patent
Liu

(10) Patent No.: US 6,266,896 B1
(45) Date of Patent: Jul. 31, 2001

(54) SHOE SOLE OF LIGHTWEIGHT

(75) Inventor: Wen-Chi Liu, Taihung Hsien (TW)

(73) Assignee: Ding Sheug Industry Co., Ltd., Taichung Shing (TW)

( * ) Notice: Subject to any disclaimer, the term of this patent is extended or adjusted under 35 U.S.C. 154(b) by 0 days.

(21) Appl. No.: 09/528,872

(22) Filed: Mar. 20, 2000

(51) Int. Cl.[7] ..... A43B 13/18

(52) U.S. Cl. ..... 36/28; 36/29; 36/3 B; 36/30 A; 36/32 R

(58) Field of Search ..... 36/28, 30 A, 32 R, 36/30 R, 100, 103, 93, 35 R, 88, 141, 59 R, 3 B, 29, 3 R, 33

(56) References Cited

U.S. PATENT DOCUMENTS

| | | | | |
|---|---|---|---|---|
| 4,223,456 | * | 9/1980 | Cohen | 36/29 |
| 4,494,322 | * | 1/1985 | Klagmann | 36/28 |
| 4,597,199 | | 7/1986 | Hong | 36/114 |
| 4,774,774 | * | 10/1988 | Allen, Jr. | 36/28 |
| 4,852,274 | * | 8/1989 | Wilson | 36/29 |
| 4,864,738 | * | 9/1989 | Horovitz | 36/29 |
| 5,025,573 | | 6/1991 | Giese et al. | 36/30 R |
| 5,044,096 | * | 9/1991 | Polegato | 36/3 R |
| 5,493,791 | * | 2/1996 | Kramer | 36/28 |
| 6,061,928 | * | 5/2000 | Nichols | 36/28 |

FOREIGN PATENT DOCUMENTS

| | | |
|---|---|---|
| 0190714 | 8/1986 | (EP) . |
| 1221716 | 6/1960 | (FR) . |

* cited by examiner

*Primary Examiner*—Paul T. Sewell
*Assistant Examiner*—Jila M. Mohandesi
(74) *Attorney, Agent, or Firm*—Harrison & Egbert

(57) ABSTRACT

A shoe sole including a shoe sole casing and a polyurethane foam body encased by the shoe sole casing. The shoe sole casing is made of a material having a high specific gravity. The shoe sole casing has a top layer and a bottom layer with a plurality of through holes formed in the top layer. The polyurethane foam body has an ultra lightweight and a plurality of material-reducing holes corresponding in location to the through holes of the shoe sole casing. The polyurethane foam body is provided with a plurality of through holes, with each having a connection rod extending from the top layer to the bottom layer of the casing therein for placing the polyurethane foam body in the shoe sole casing.

2 Claims, 4 Drawing Sheets

SHOE SOLE OF LIGHTWEIGHT

FIELD OF THE INVENTION

The present invention relates generally to a shoe sole, and more particularly to a shoe sole which is provided with means to reduce the weight of the shoe sole.

BACKGROUND ART

As shown in FIGS. 1 and 2, a prior art shoe sole 10 is provided with a number of blind holes 11 for reducing the weight of the prior art shoe sole 10 and for reducing the amount of the material that is used to produce the shoe sole 10. The use of the blind holes 11 to reduce the weight of the shoe sole 10 and the amount of the material of which the shoe sole 10 is made is rather primitive at best and is rather ineffective. The structural strength of the shoe sole 10 is apt to to be weakened by the blind holes 11, thereby making the shoe sole 10 a safety hazard.

SUMMARY OF THE INVENTION

The primary objective of the present invention is to provide a shoe sole which is light in weight.

It is another objective of the present invention to provide a shoe sole which is light in weight and yet strong in structure.

It is still another objective of the present invention to provide a lightweight shoe sole which is cost-effective.

In keeping with the principle of the present invention, the foregoing objectives of the present invention are achieved by a shoe sole which is made of a polyurethane foam body of an ultra lightweight material and having a plurality of through holes, with each being provided therein with a connection rod for connecting the upper side and the lower side of the shoe sole. The polyurethane foam body is provided with a plurality of material-reducing holes to minimize the production cost of the polyurethane foam body.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
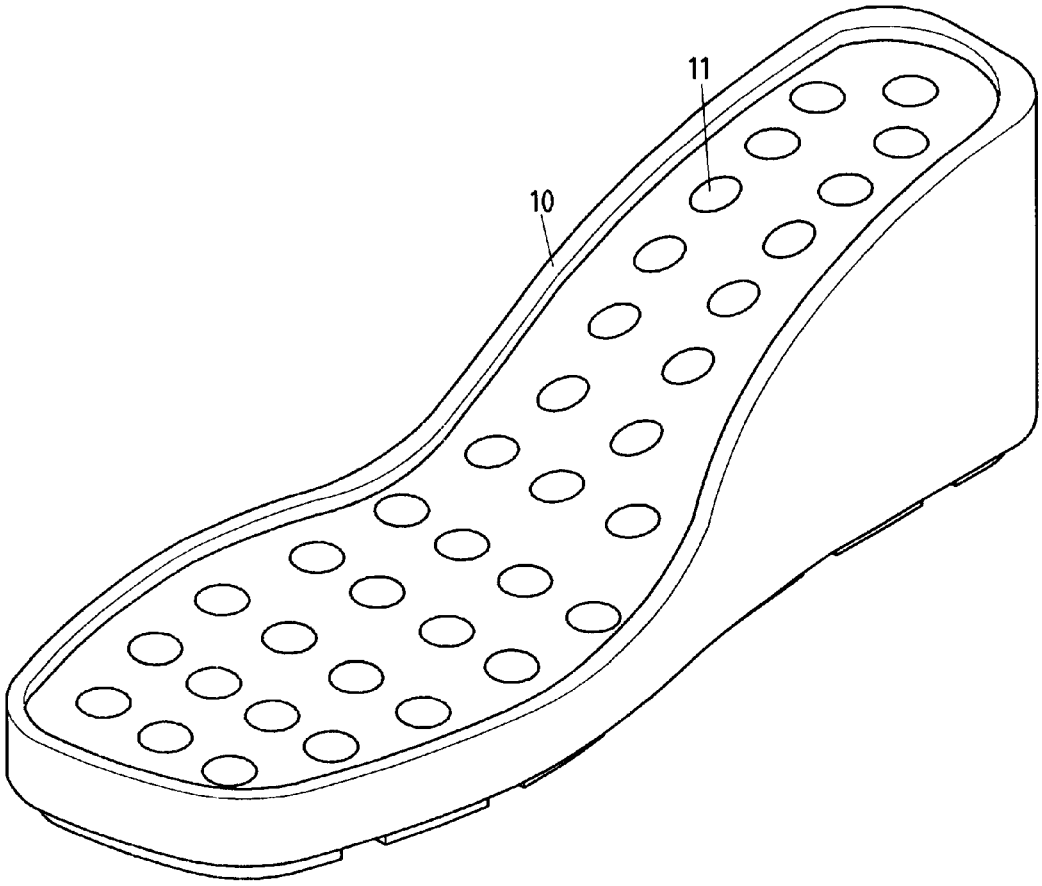
FIG.1 PRIOR ART
FIG. 1 shows a perspective view of a shoe sole of the prior art.
Figure 2:
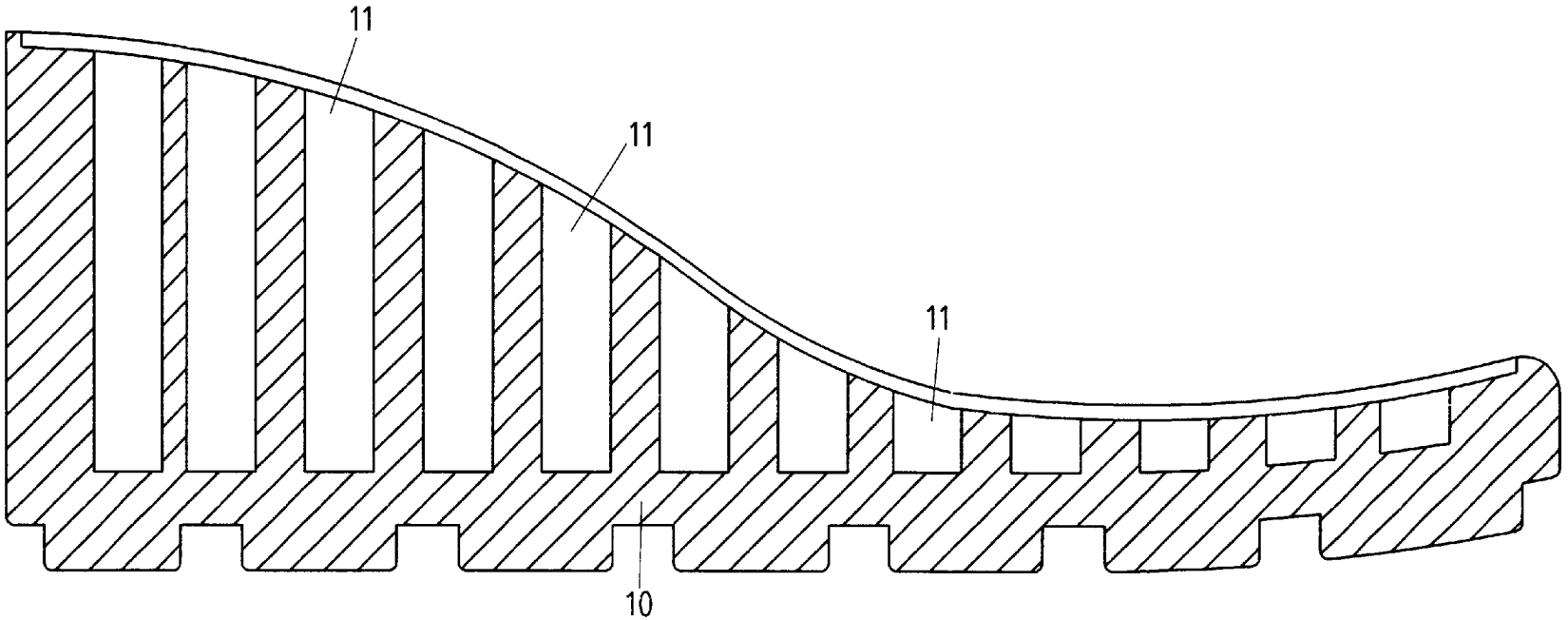
FIG. 2 PRIOR ART
FIG. 2 shows a side sectional view of the shoe sole of the prior art.
Figure 3:
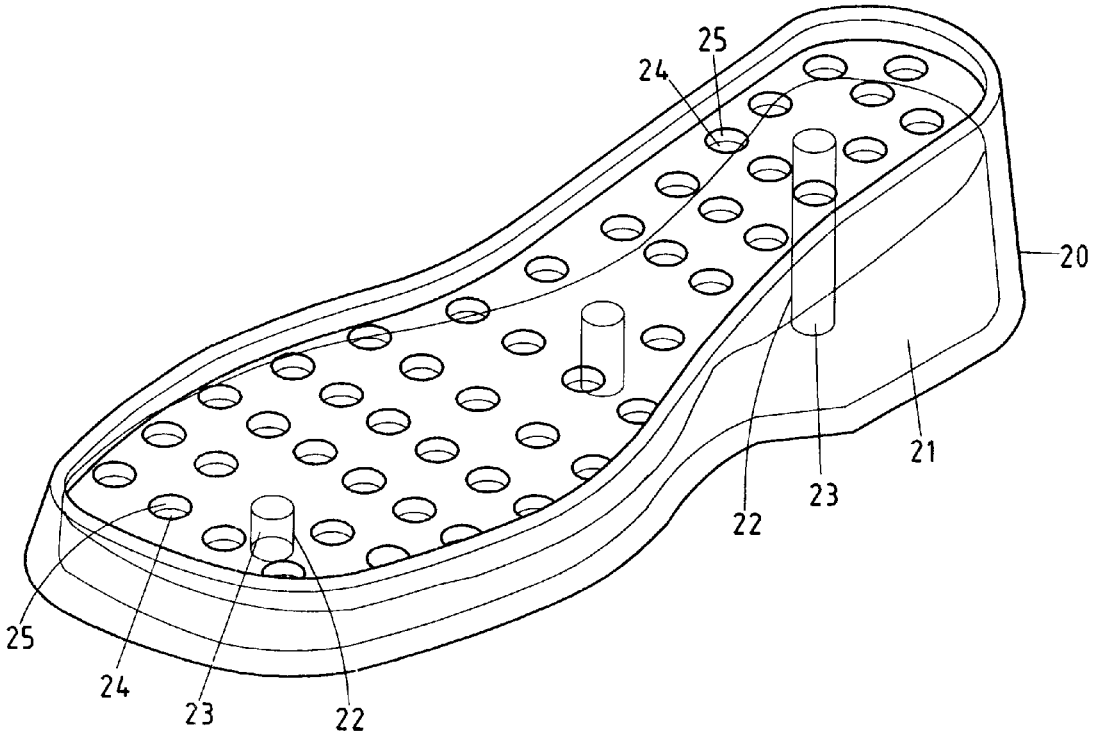
FIG. 3 shows a perspective view of a shoe sole of the preferred embodiment of the present invention.
Figure 4:
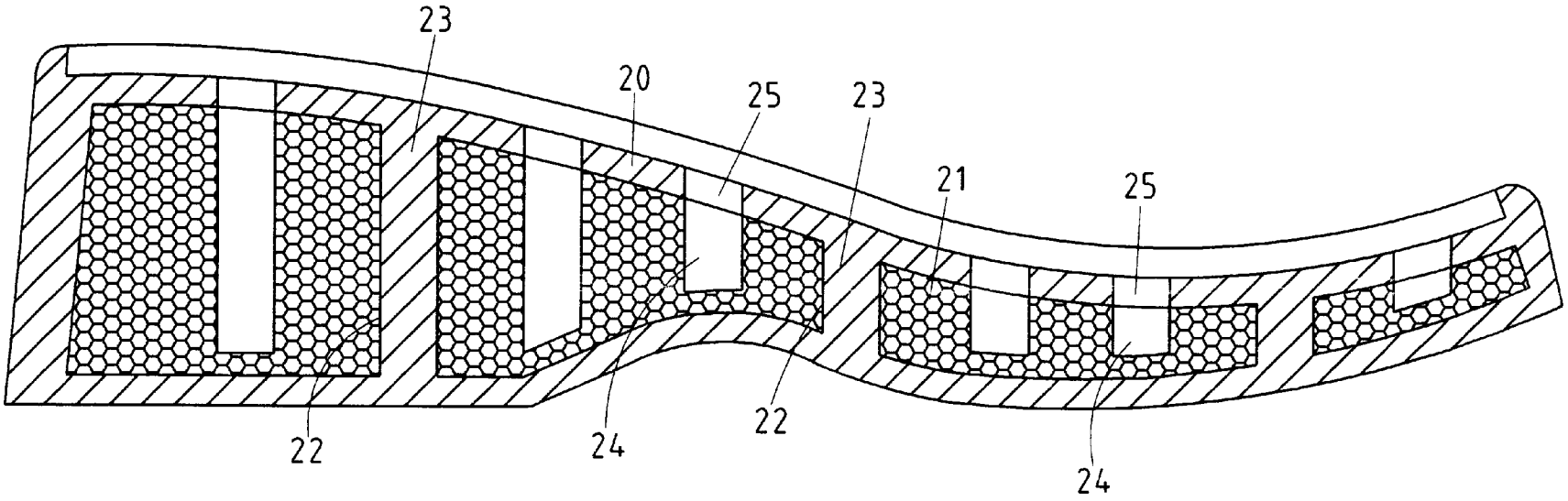
FIG. 4 shows a side sectional view of the shoe sole of the preferred embodiment of the present invention.

As shown in FIGS. 3 and 4, a shoe sole embodied in the present invention is formed of a shoe sole casing 20 and a polyurethane foam body 21 encased by the shoe sole casing 20.

The shoe sole casing 20 is made of a material of a high specific gravity by injection molding or die casting. The shoe sole casing 20 has an upper layer and a bottom layer. A plurality of through holes are formed through the upper layer.

The polyurethane foam body 21 is made by injection molding or die casting. The polyurethane loam body 21 is ultra lightweight. The polyurethane foam body 21 is provided with a plurality of through holes 22 and connection rods 23 which are received in the through holes 22 for placing the polyurethane foam body 21 in the shoe sole casing 20. The polyurethane foam body 21 is further provided with a plurality of material-reducing holes 24 corresponding in location to the through holes 25 of the shoe sole casing 20. The material-reducing holes 24 of the polyurethane foam body 21 are intended to reduce the amount of the material of which the polyurethane foam body 21 is made of.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A shoe sole comprising:

a casing having a top layer and a bottom layer, said casing having a plurality of through holes extending through said top layer; and a polyurethane foam body having a plurality of material-reducing holes, said foam body being encased by said casing such that said material-reducing holes are respectively aligned with said plurality of through holes, said casing being formed of a denser material than a material said foam body.

2. The shoe sole of claim 1, said casing having connection rods extending from said top layer to said bottom layer, said foam body having through holes formed therein through which respective connection rods extend.

* * * * *